United States Patent [19]

Junkers

[11] 4,027,561

[45] June 7, 1977

[54] HYDRAULIC WRENCH

[76] Inventor: John K. Junkers, 7 Arrowhead Lane, Saddle River, N.J. 07458

[22] Filed: Nov. 19, 1975

[21] Appl. No.: 633,249

[52] U.S. Cl. ..... 81/57.39
[51] Int. Cl.[2] ..... B25B 13/46
[58] Field of Search ..... 81/57.39; 173/163

[56] References Cited

UNITED STATES PATENTS

| | | | |
|---|---|---|---|
| 1,812,816 | 6/1931 | Weaver | 81/57.39 |
| 3,575,069 | 4/1971 | White | 81/58.1 |
| 3,706,244 | 12/1972 | Wilmeth | 81/57.39 |
| 3,745,858 | 7/1973 | Biach | 81/57.39 |
| 3,930,776 | 1/1976 | Keller | 81/57.39 |

*Primary Examiner*—James L. Jones, Jr.
*Attorney, Agent, or Firm*—Michael J. Striker

[57] ABSTRACT

A hydraulically operated wrench for tightening and loosening threaded connectors, such as nuts and bolts, includes a shaft and a socket removably mounted on one end of the shaft for engaging a polygonal portion of a threaded connector which has to be tightened or loosened. The shaft carries a ratchet wheel for rotation therewith which is operated by a ratchet pawl pivotally mounted intermediate the ends of a first lever, one end of which is pivotally mounted on the shaft. A second lever is pivotally mounted on one end on the shaft, whereas a cylinder-and-piston unit is pivotally connected at opposite ends to the other ends of the first and second lever so that during reciprocation of the piston in the cylinder the shaft and the socket are rotated to tighten or loosen the threaded connector engaged by the socket. Such action will tend to swing the frame composed of the two levers and the cylinder-and-piston unit about the shaft axis in a direction opposite to the direction of rotation of the shaft, and the apparatus is provided with means to prevent such movement of the frame.

13 Claims, 7 Drawing Figures

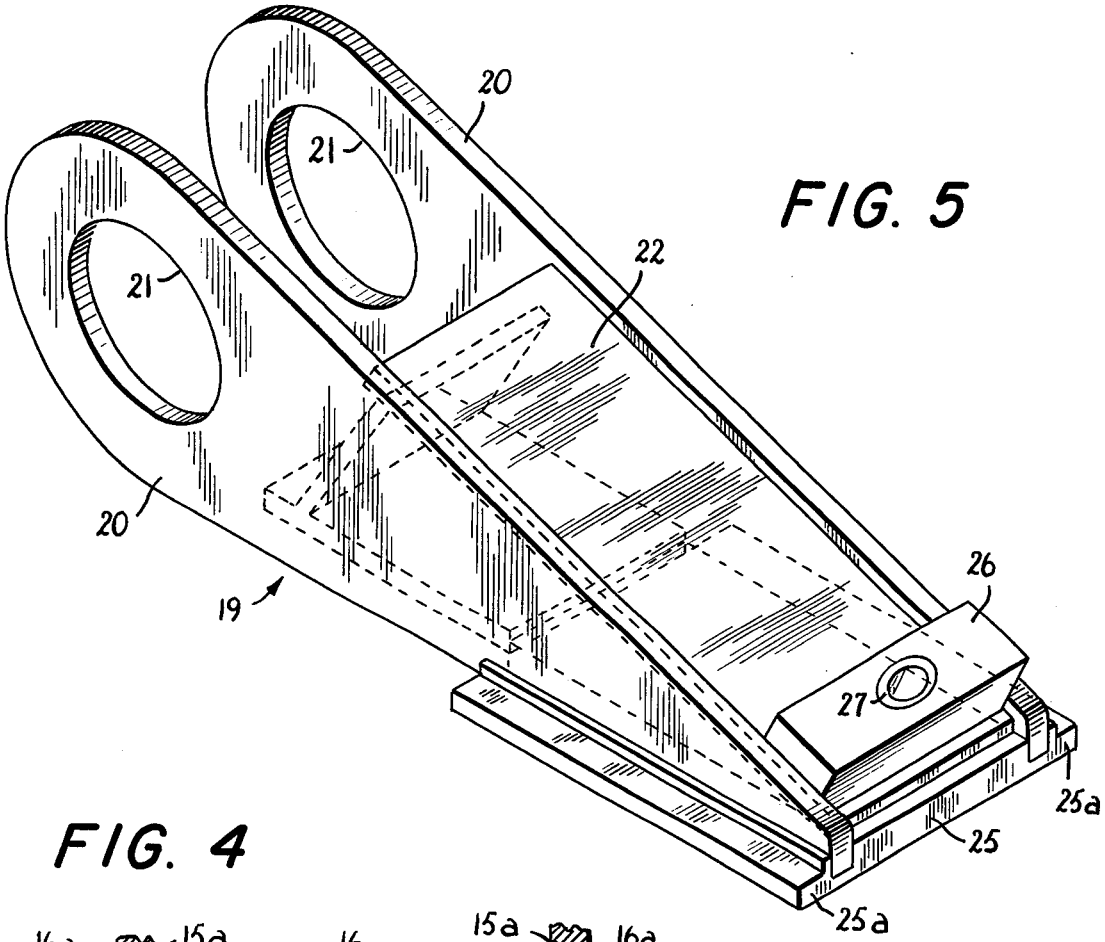
FIG. 5
FIG. 4
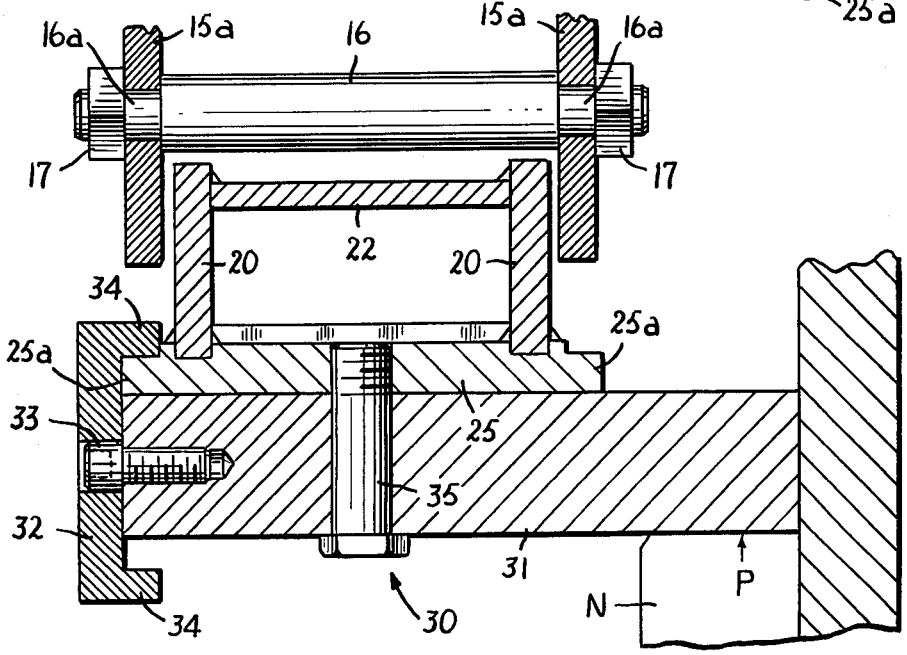

HYDRAULIC WRENCH

BACKGROUND OF THE INVENTION

The present invention relates generally to wrenches and more particularly to hydraulic wrenches.

More specifically, the present invention relates to hydraulic wrenches which can be advantageously used for tightening and loosening threaded connectors such as nuts mounted on bolts in which a plurality of nuts which are closely adjacent to each other have to be tightened and loosened and in which the overhead clearance for applying a wrench to the nuts is rather limited, which would make it impossible to use a standard air or impact wrench.

SUMMARY OF THE INVENTION

It is an object of the present invention to provide a hydraulic wrench which can be used for tightening or loosening threaded connectors which are closely adjacent to each other and in which the overhead space for applying a wrench is limited.

It is a further object of the present invention to provide a hydraulic wrench by means of which a large constant torque can be applied to the threaded connector which has to be tightened or loosened.

It is an additional object of the present invention to provide for a hydraulic wrench of the aforementioned kind which can be easily adapted for use of threaded connectors of different size.

It is also an object of the present invention to provide a hydraulic wrench of the aforementioned kind which is simple in construction so that it can be built at reasonable cost and which will stand up perfectly under extended use.

With these and other objects in view, which will become apparent as the description proceeds, the hydraulic wrench according to the present invention mainly comprises a shaft, at least one ratchet wheel fixed to the shaft for rotation therewith about the axis thereof, frame means located substantially in a plane normal to the axis of the shaft and comprising a first lever pivotally connected at one end to the shaft, a second lever pivotally connected at one end of the shaft and including an angle with the first lever, fluid operated expandable and contractable cylinder-and-piston means pivotally connected at opposite ends to the other ends of the first and the second lever, respectively, and a ratchet pawl pivotally carried by the first lever intermediate the ends of the latter and engaging the teeth of the ratchet wheel for turning the ratchet wheel and the shaft connected thereto during operation of the cylinder-and-piston means. An exchangeable socket is mounted on one end of the shaft for engaging a polygonal head of a threaded connector for tightening or loosening the same, whereby during such operation a force is created tending to turn the frame about the axis of the shaft in a direction opposite to the direction the shaft is turned. The hydraulic wrench includes further means connected to the frame means for counteracting such force.

The means for counteracting such force comprise a torque arm pivotally attached at one end to the shaft and projecting from the latter in the general direction of the second lever, a curved first abutment fixed to the torque arms spaced from the shaft, a second abutment on an adjacent part of the frame means and engaging the first abutment, and a bracket attached at one end to the torque arm in the region of the other end and projecting therefrom substantially parallel to the shaft and adapted to abut with a side face thereof against a fixed abutment, for instance a nut adjacent to the nut which has to be tightened or loosened.

A spring normally maintains the ratchet pawl in engagement with the teeth of the ratchet wheel, and the wrench includes further operator controllable means for holding the ratchet pawl out of engagement with the teeth of the ratchet wheel so that the ratchet wheel together with the shaft may be turned independently of the cylinder-and-piston unit for instance, if the available space permits, by a nut runner connectable to the shaft so that the nut to be tightened may during a first part of the tightening process be turned very fast by the nut runner while the ratchet pawl is disengaged from the teeth of the ratchet wheel and subsequently be tightened with the necessary torque by the hydraulic wrench while the ratchet pawl is reengaged with the teeth of the ratchet wheel.

Instead of a single ratchet wheel cooperating with a single pawl, the hydraulic wrench according to the present invention may also be provided with three ratchet wheels and three pawls cooperating therewith in which two of the three ratchet wheels are arranged to opposite sides of the central ratchet wheel and in which all of the ratchet wheels have an equal number of teeth and the same circumferential pitch, but in which the teeth of the two outside ratchet wheels, which are transversely aligned with each other are circumferentially offset with respect to the teeth of the central ratchet wheel through half a pitch.

This arrangement permits to apply a very large torque to the connector which has to be tightened or loosened and in which the force applied to the threaded connector remains substantially constant during such tightening or loosening process.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 4 is a partial cross-section taken along the line 4—4 of FIG. 2;

FIG. 5 is a perspective view of the torque arm;

Figure 1:
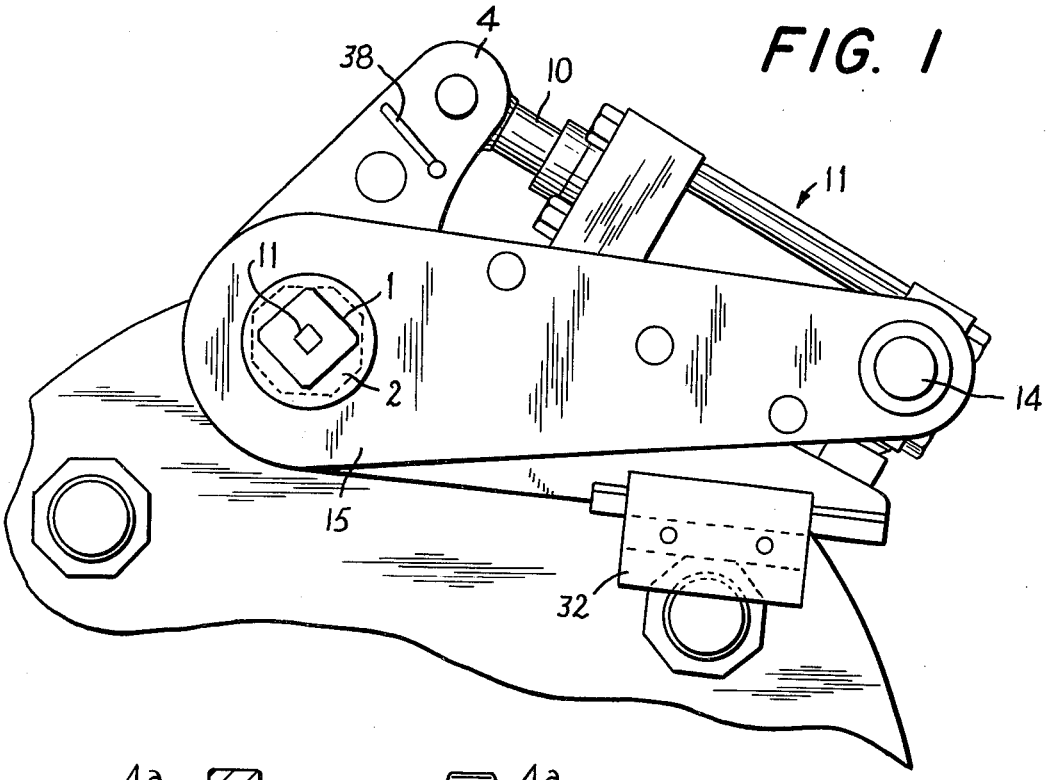
FIG. 1 is a top view of the hydraulic wrench according to the present invention and showing the wrench applied to one of a plurality of adjacent threaded connectors for tightening or loosening the same.
Figure 3:
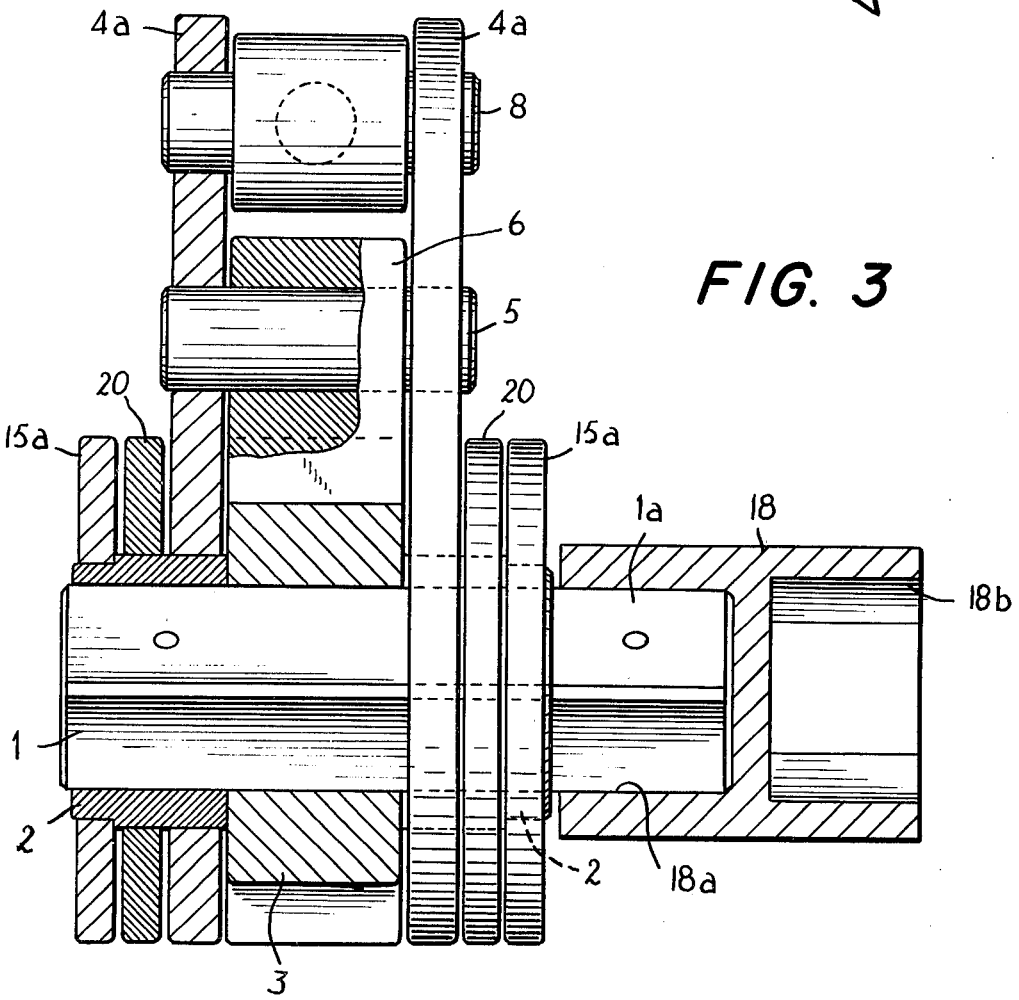
FIG. 3 is a partial cross-section through the wrench taken along the line 3—3 of FIG. 2.
Figure 2:
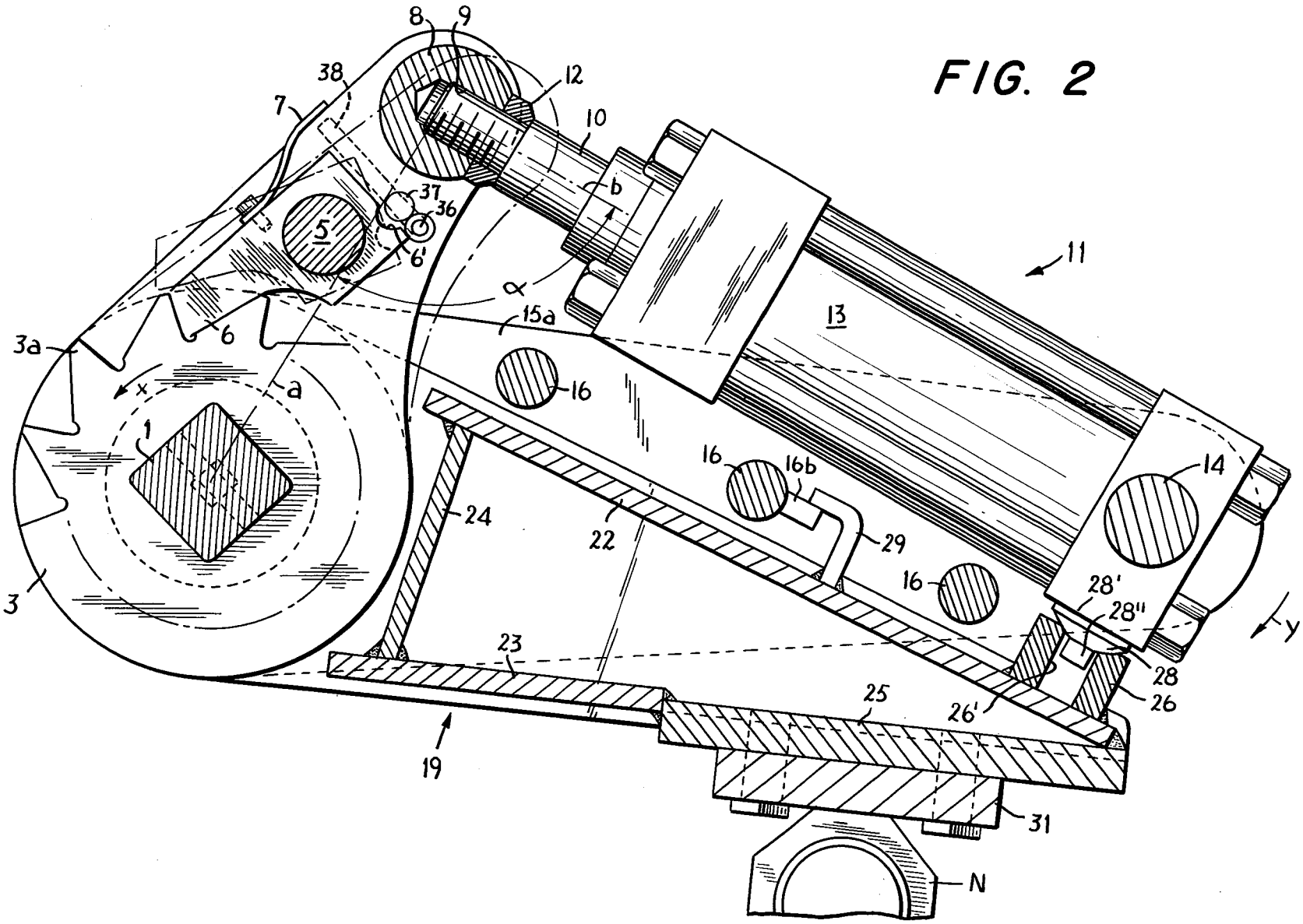
FIG. 2 is a partially sectioned top view of the hydraulic wrench shown in FIG. 1 and drawn to a larger scale.

DESCRIPTION OF THE PREFERRED EMBODIMENTS:

Referring now to the drawing, and more specifically to FIGS. 1–5 of the same, it will be seen that the hydraulic wrench according to the present invention comprise shaft means including an elongated member 1 of substantially square cross-section and a pair of transversely spaced annular members 2 (FIG. 3) having each a central opening of correspondingly square cross-section through which the elongated member 1 extends and an outer cylindrical surface. A ratchet wheel 3 having a central opening of square cross-section is mounted on the elongated member 1 of the shaft means between the sleeves 2. The wrench includes further first lever means 4 comprising a pair of transversely spaced arms 4*a* respectively pivotally mounted on the sleeves 2 at opposite sides and adjacent to the ratchet wheel 3. A pin 5 extends parallel to the member 1 through appropriate bores in the arms 4*a* intermediate opposite ends of the latter, and the pin 5 carries pivotably about the axis thereof a ratchet pawl 6 adapted to engage with the free end thereof the teeth 3*a* of the ratchet wheel, as best shown in FIG. 2. A leaf spring 7 connected at one end to the ratchet pawl 6 engages with its free end the side arms 4*a* of the first lever for holding the ratchet pawl 6 in engagement with the teeth 3*a* of the ratchet wheel. A second pin 8 is pivotally mounted in appropriate bores of the two arms 4*a* of the first lever 4 adjacent the other end of the latter. The pin 8 is provided intermediate the ends thereof with a threaded bore 9 in which a correspondingly threaded end of a piston rod 10 of a hydraulically operated cylinder-and-piston unit 11 is threadingly engaged. A washer 12 is preferably provided between a shoulder formed at the piston rod 10 and a corresponding flat provided on the pin 8. The cylinder-and-piston unit 11 is of standard construction and the piston thereof connected to the free end of the piston rod 10 is not shown in the drawing. Likewise not shown in the drawings are the conduits for feeding pressure fluid into and out of the cylinder 13 of the cylinder-and-piston unit 11 for reciprocating in a known manner the piston and the piston rod connected thereto. A pair of stud shafts 14, only one of which is shown in FIGS. 1 and 2 project transverse to the axis of the cylinder 13 from the region of the end of the latter opposite to the end from which the piston rod 10 projects. The stud shafts 14 are pivotally mounted in appropriate bores in a pair of arms 15*a* of a second lever 15, and the other ends of the arms 15*a* are pivotally mounted on the annular members 2, respectively outside and laterally spaced from the arms 4*a* of the first lever 4. Three pins 16 extend spaced from each other, as best shown in FIG. 2 between the side arms 15*a* of the second lever 15 and each of the pins has, as best shown in FIG. 4, a pair of outer portions 16*a* of reduced diameter extending through appropriate bores in the arms 15*a* whereas nuts 17 are connected to the outer threaded portions of reduced diameter so that the arms 15*a* of the second lever are pressed against the shoulders of the pins 16 formed between the outer portions of reduced diameter and the central portion thereof, whereby the arms 15*a* are held spaced from each other at a fixed distance. One of the pins 16 is provided with a flat lateral projection 16*b* (FIG. 2) for a purpose as will be described later on.

The member 1 of square cross-section of the shaft means projects with an end portion 1*a* beyond one of the arms 15*a* of the second lever 15 (FIG. 3) and a socket 18 is releasably connected to this projecting portion 1*a* of the member 1. The socket 18 has at one end a cavity 18*a* matching the cross-section of the portion 1*a* and at the other end a cavity 18*b* of hexagonal cross-section. It is to be understood that the wrench is provided with a plurality of such sockets each of which has a cavity or pocket 18*a* matching the cross-section of the end portion 1*a*, whereas the other cavity 18*b* may be larger or smaller than that shown in FIG. 3 to engage with nuts or similar threaded connectors of different size so that the wrench may be used for tightening or loosening threaded connectors of various sizes by simply exchanging the sockets 18.

During operation of the hydraulic wrench so far described at which the shaft means is rotated by the ratchet mechanism and the cylinder-and-piston unit connected thereto for instance in the direction of the arrow *x* shown in FIG. 2 for tightening, for instance, a nut engaged in the cavity 18*b* of the socket 18, a force is applied to the frame means of the wrench, comprising the first lever 4, the second lever 15, and the cylinder-and-piston unit 11, which tends to move the aforementioned frame means about the axis of the shift in the direction of the arrow y as indicated in FIG. 2.

The hydraulic wrench includes further means for counteracting this force and to prevent such rotation of the frame means during operation of the wrench for tightening or loosening a threaded connector. The means for counteracting this force comprise a torque arm 19 of a configuration as best shown in FIG. 5. The torque arm 19 comprises a pair of transversely spaced side plates 20 provided in the region of one end with circular openings 21 mounted for pivotal movement on the annular members 2 between the arms 4*a* of the first lever and the arms 15*a* of the second lever and the side plates 20 are connected spaced from each other by a top plate 22 and a bottom plate 23 as well as a plate 24 extending between the plates 22 and 23 spaced from the openings 21. The bottom plate 23 has an offset portion 25 which extends with lateral portions 25*a* to opposite sides of side plates 20, as best shown in FIGS. 4 and 5. The aforementioned plates of the torque arm 19 are all welded to each other to form a unitary member. The torque arm includes further a block or abutment 26 connected, for instance by welding, to the top plate 22 thereof and projecting upwardly from the latter towards the end of the cylinder and piston unit 11 on which the stud shafts 14 are provided. The block 26 is formed on the upper surface thereof with a concave, part-spherical depression 27 in which a correspondingly shaped convexly formed portion of an abutment member 28 engages which is sandwiched between the block 26 and a corresponding portion of the piston 13. The member 28 has an upper planar surface 28′ which slidably abuts against the corresponding surface of the piston 13. The member 28 has a downwardly extending pin 28 ″ which extends with ample clearance into a bore 26′ formed in the block to limit axial movement of the member 28 with regard to the cylinder 13 while permitting the latter to tilt to a certain extent about the spherical surface of the cavity 27 in the block 26. A hook-shaped member 29 is welded to the top plate 22 of the torque arm 19 and engages the lateral projection 16*b* of one of the pins 16 to prevent the torque arm 18 to move away from the second lever 15.

The means for counteracting the force tending to move the frame means during operation in direction of the arrow *y* about the axis of the shaft 1 include further a bracket 30 comprising a plate 31 adapted to abut with a face thereof against a corresponding face of the plate 25 of the torque arm 19 and carrying at the upper end thereof a plate 32 fixedly connected thereto by screws 32 or the like and having at opposite end edges thereof downwardly extending projections 34 so that the bracket 30 may be hooked onto one of the projections 25*a* of the bottom plate 25 of the torque arm 19 in the manner as best shown in FIG. 4. The plate 31 of the bracket 20, when the latter is hooked onto one of the projections 25*a* as shown in FIG. 4, projects downwardly beyond the other projection 25*a* and is adapted to abut, with a side face thereof opposite to the side face abutting against the plate 25 of the torque arm 19, against one of the plurality of nuts which have to be tightened in the manner as best shown in FIGS. 1 and 4 so that the bracket 30 and the torque arm 19 connected thereto will prevent rotation of the frame means in the direction of the arrow *y* during operation of the cylinder-and-piston unit 1 for turning the ratchet wheel 3 in the direction of the arrow *x* during tightening or loosening of a threaded connector engaged in the cavity 18*b* of the socket 18.

The plate 31 of the bracket 30 is preferably connected to the bottom plate 25 of the torque arm by one or two screw bolts 35 threaded into appropriately threaded bores of the bottom plate 25.

The reaction force P between the nut N and the lower end of the plate 31 imparts to the torque arm 19 also a twisting force tending to twist the torque arm 19 about an axis normal to the axis of the member 1, however, this twisting force is imparted to the sturdy member 1 and due to the spherical abutment faces of the cavity 27 in the block 26 of the torque arm and the corresponding spherical face of the member 28 such twisting force is not transmitted to the cylinder-and-piston unit 11 or to any other of the members of the aforementioned frame means so that the pivotal connection established by the pin 8 between the arms of the first lever 4 and the piston rod 10 and the other pivotal connection between the stud shafts 14 and the arms 15*a* of the second lever 15 are not subjected to any twisting force which would detrimentally effect the free pivotal movement of the pin 8 or the stud shafts 14 in the corresponding openings of the first and second lever. This will assure trouble-free operation of the wrench according to the present invention and especially reduce wear on the various elements thereof.

Preferably, the wrench includes also means for maintaining the pawl 6 against the force of the spring 7 out of engagement with the teeth of the ratchet wheel 3. Such means may include a pin 36 pivotally mounted in appropriate bores of the arms 4*a* of the first lever 4 and projecting with opposite ends beyond these arms and carrying between the arms 4*a* a lateral rounded projection 37 adapted to engage in a corresponding cutout 6′ on the end face of the pawl 6 opposite the tip thereof which is adapted to engage the teeth of the ratchet wheel 3 and a pair of levers 38 are connected to the projecting ends of the pin 36, respectively, so that when the pin 36 and the projection 37 thereon are turned by means of the levers 38 in counterclockwise direction, the projection 37 will engage the cutout 6′ on the pawl 6 to turn the latter from the full line position shown in FIG. 2 to the dash-dotted line position to thereby maintain the tip of the pawl 6 out of engagement with the teeth of the ratchet wheel. This will permit to turn the ratchet wheel 3 and the member 1 with the socket 18 attached thereto independently of the operation of the cylinder-and-piston unit 11 so that the shaft means 1, 2 may be turned quickly at the start of the operation of the wrench, for instance by attaching a nut runner or similar fast operating turning means to the member 1 for which purpose the upper end of the member 1 is formed with a square cavity 1″.

The lengths of the levers 4 and 15 as well as that of the cylinder-and-piston unit 11 and the pivotal connection of the latter to the ends of the levers 4 and 15 is chosen in such a manner that the angle $\alpha$ included between a line *a* connecting the center of the ratchet wheel 3 with the center of the pivot pin 8 and the center line *b* of the cylinder-and-piston unit 11 is substantially 90° at a position of the cylinder-and-piston unit 11 midway between the end of the forward and the return stroke of the latter. This will assure that the torque applied to the member 1, respectively to the socket 18 connected thereto and the nut or the like engaged in the cavity 18*b* of the socket will be substantially constant during the operation of the wrench.

Figure 7:
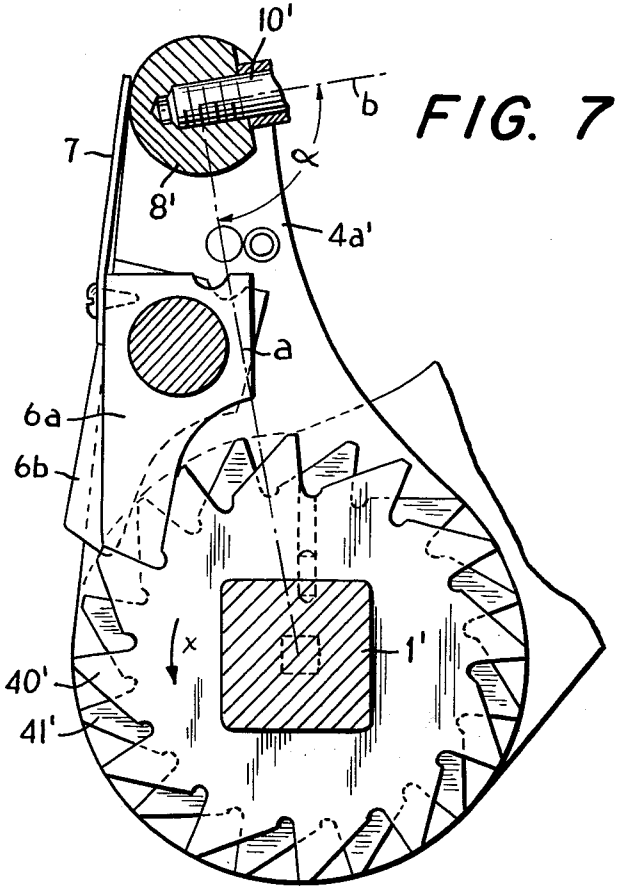
FIG. 7 is a cross-section taken along the line 7—7 of FIG. 6.
Figure 6:
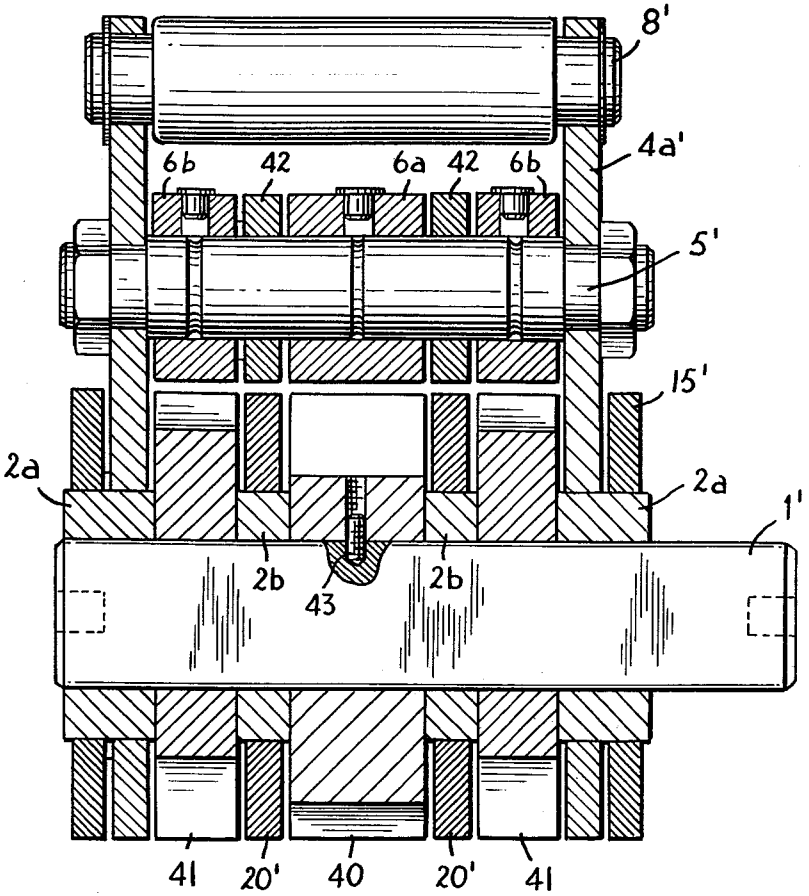
FIG. 6 is a cross-section similar to FIG. 3 and showing a modification of the hydraulic wrench shown in FIGS. 1–5.

FIGS. 6 and 7 partially illustrate a modification of the above-described hydraulic wrench. Elements serving the same purpose as in the embodiment shown in FIGS. 1–5 are designated in FIGS. 6 and 7 with the same reference numeral to which a prime is added. The main difference between the first embodiment illustrated in FIGS. 1–5 and the embodiment illustrated in FIGS. 6 and 7 is that the latter embodiment includes instead of a single ratchet wheel 3, a central ratchet wheel 40 and two additional ratchet wheels 41 mounted on the member 1′ to opposite sides of the central ratchet wheel 40 and correspondingly, this modification includes also three ratchet pawls, that is a central ratchet pawl 6*a* and two lateral ratchet pawls 6*b* pivotally mounted on the pin 5′. Each of the ratchet wheels 40 and 41 has the same number of teeth 40′ and 41′, respectively, but the teeth of the outside ratchet wheels 41′ are angularly displaced through half a pitch with regard to the teeth 40′ of the central ratchet wheel 40. The cylinder-and-piston unit 11, not shown in FIGS. 6 and 7, but operatively connected to the arms 4*a*′ of the first lever and the arms 15*a*′ of the second lever, in the manner as described before, can operate with half of the stroke of the cylinder-and-piston unit 11 shown in the embodiment described in connection with FIGS. 1–5. At the end of one forward stroke of the piston rod 10′ of the cylinder-and-piston unit the tip of the central pawl 6*a* will engage the radial face of a corresponding tooth 40′ of the central ratchet 40 to turn the latter in the direction of the arrow *x*, whereas the pawls 6*b* for the outside ratchets 41 will slide over the corresponding tips of the teeth 41′. At the end of the rearward or inward stroke of the piston rod 10′ the tips of the pawl 6*b* will engage the radial face of corresponding teeth 41′ of the outside ratchet wheel 41, whereas the tip of the central ratchet pawl 6*a* will be lifted out of engagement with the radial face of the corresponding tooth 40′. The small stroke at which the cylinder and piston unit may be operated with the embodiment shown in FIGS. 4 and 7 will assure that the angle $\alpha$ included between the lines *a* and *b* will deviate at the end of the forward and rearward stroke of the piston rod 10′ only by a very small increment from the desired angle of 90° so that the torque applied to the member 1′, the socket 18, not shown in FIG. 6, connected thereto and the nut or the like engaged in the cavity of the socket will remain substantially constant since the angle $\alpha$ included between the lines *a* and *b* will vary only to a minimum degree during the forward and rearward stroke of the piston rod 10′. In the modification shown in FIGS. 6 and 7, four annular members 2*a* and 2*b* are mounted on the square member 1′ and in this modification the side plates 20′ of the torque arm 19 only partially shown in FIGS. 6 and 7 are mounted on the inner members 2*b*, whereas the arms 4*a*′ and 15*a*′ of the first and second lever are mounted on the outer annular members 2*a*. The central ratchet 40 is preferably held by a set screw 43 on the member 1′ and the outer annular members 2*a* may also be held by corresponding set screws, not shown in FIG. 5. This arrangement preferably includes annular spacer members 42 on the pin 5′ between the central pawl 6*a* and the outside pawls 6*b*.

The conduits for feeding pressure fluids into and out of the cylinder 13 of the cylinder-and-piston unit 11 to reciprocate the piston rod 10 or 10′ between a forward and a rearward stroke are not shown in the drawing, since such an arrangement is well known in the art. Such an arrangement including appropriate valves and fluid pressure actuated switches is for instance shown in the copending application Ser. No. 498,246 filed Aug. 16, 1974, and assigned to the same assignee.

The operation of the above-described hydraulic wrench will be obvious from the description thereof. When a nut or similar threaded connector has to be tightened or loosened, the nut is engaged in the socket portion 18*b* and the whole frame comprising the levers 4 and 15 with the cylinder and piston unit 11 connected thereto is then turned preferably while the pawl or pawls are disengaged from the teeth of the ratchet wheel or wheels until the side face of the plate 31 of the bracket 30 engages the head of a nut or similar projection adjacent to the nut to be tightened as shown in FIG. 1. Subsequently thereto the cylinder and piston unit 11 is actuated to turn the ratchet wheel or ratchet wheels and the shaft means connected thereto in the direction as indicated by the arrow *x* to tighten the nut on the corresponding bolt, and the cylinder-and-piston unit 11 may be automatically deactivated by the above-mentioned arrangement upon application of a maximum torque to the nut to be tightened.

It will be understood that each of the elements described above, or two or more together, may also find a useful application in other types of hydraulically operated wrenches, differing from the types described above.

While the invention has been illustrated and described as embodied in a hydraulic operated wrench, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A hydraulic wrench comprising shaft means having an axis; at least one ratchet wheel fixed to said shaft means for rotation with the same about the axis thereof; frame means located substantially in a plane normal to the axis of said shaft means and comprising first lever means pivotally connected at one end to said shaft means, second lever means pivotally connected at one end to said shaft means and including an angle with said first lever means, and fluid operated expandable and contractable cylinder-and-piston means pivotally connected at opposite ends to the other ends of said first lever and second lever means, respectively; at least one ratchet pawl pivotally carried out by said first lever means intermediate the ends of the latter and engaging the teeth of said ratchet wheel for turning the ratchet wheel and the shaft means connected thereto; exchangeable socket means mounted at one end of said shaft means for engaging a polygonal head of a threaded connector for turning the latter, whereby during such turning of the threaded connector in one direction a force is created tending to turn said frame means about the axis of said shaft means in the opposite direction; and means pivotally attached at one end to said shaft means and in the region of the other end operatively connected to said frame means and adapted to engage a fixed abutment adjacent to the threaded connector to be turned for counteracting said force.

2. A hydraulic wrench as defined in claim 1, wherein said cylinder-and-piston means comprises a cylinder pivotally connected at one end to the other end of said second lever means, a piston rod projecting beyond the other end of said cylinder and being pivotally attached to the other end of said first lever means.

3. A hydraulic wrench as defined in claim 1, wherein said means for counteracting said force comprises a torque arm pivotally attached at one end of said shaft means and projecting from said shaft means in the general direction of said second lever means, first abutment means fixed to said torque arm spaced from said shaft means, second abutment means on an adjacent part of said frame means and engaging said first abutment means, and a bracket attached at one end to said torque arm in the region of the other end of the latter and projecting therefrom substantially parallel to said shaft means and adapted to abut with a side face thereof a fixed abutment adjacent to the threaded connector to be turned.

4. A hydraulic wrench as defined in claim 3, wherein said first abutment means comprises a first member fixed in the region of the other end of the torque arm to the latter, and a second member sandwiched between said first member and the one end of said cylinder, one of said members having a convexly curved spherical face and the other member having a concavely curved spherical face in engagement with said convexly curved spherical face, and including cooperation means on said torque arm and said second lever means for maintaining said spherical faces in engagement with each other.

5. A hydraulic wrench as defined in claim 3, wherein said shaft means comprises an elongated member of square cross-section, and at least one pair of transversely spaced annular members having each a central opening of corresponding square cross-section through which said elongated member extends and an outer cylindrical surface on which said first and second lever means and said torque arm are pivotally mounted, said ratchet wheel having a central opening matching the square cross-section of said elongated member and being located between said annular members.

6. A hydraulic wrench as defined in claim 5, wherein said first lever means comprises a pair of transversely spaced arms pivotally mounted at one of the ends thereof on said annular members, a first pin extending transversely to said arms and being pivotally mounted in the region of the other ends of the latter, said pin being formed with a bore extending transversely to the axis of said pin in which said projecting end of said piston rod is anchored, a second pin parallel to said first pin and pivotally mounted on said arms between the one and the other end thereof, said ratchet pawl being pivotally mounted on said second pin between said arms.

7. A hydraulic wrench as defined in claim 5, wherein said second lever means comprises a pair of elongated transversely spaced arms pivotally mounted on one of the ends thereof on said annular members and a plurality of pins extending transversely to and fixed at opposite ends to said arms and including a transverse projection on one of said pins and a hook-shaped member on said torque arm engaging said projection for preventing said torque arm to pivot away from said second lever means.

8. A hydraulic wrench as defined in claim 5, wherein said torque arm comprises a pair of elongated transversely spaced side plates pivotally mounted at one of the ends thereof on said annular members and at least one additional plate fixed to longitudinal edges of said pair of side plates facing away from said second lever means and projecting with portions thereof outwardly beyond said side plates, said bracket comprising a first plate member having along opposite edges thereof a pair of projections normal to said first plate member and a second elongated plate member fixed to said first plate member between said pair of projections spaced from each of the same a distance equal to the thickness of said projecting portions of said additional plate so that said bracket may be hooked on either of said projecting portions with one face of said second plate member abutting against a face of said additional plate, and means for releasably attaching said second plate member to said additional plate.

9. A hydraulic wrench as defined in claim 1, and including spring means for normally maintaining said ratchet pawl in engagement with said teeth of said ratchet wheel, and operator controlled means for holding said ratchet pawl out of engagement with said teeth so that said ratchet wheel together with said shaft means may be turned independently of said cylinder-and-piston means.

10. A hydraulic wrench as defined in claim 1 wherein said first lever means extends substantially normal to the axis of the cylinder-and-piston means.

11. A hydraulic wrench as defined in claim 3, wherein said bracket is releasably attached to said torque arm.

12. A hydraulic wrench comprising shaft means having an axis; two ratchet wheels coaxially mounted on said shaft means for rotation therewith about the axis thereof, said two ratchet wheels having an equal number of teeth of the same circumferential pitch with the teeth of one ratchet wheel circumferentially offset with respect to the teeth of the other ratchet wheel through half a pitch; frame means located substantially in a plane normal to the axis of said shaft means and comprising first lever means pivotally connected at one end to said shaft means, second lever means pivotally connected at one end to said shaft means and including an angle with said first lever means, and fluid operated cylinder-and-piston means pivotally connected at opposite ends to the other ends of said first and second lever means, respectively; two ratchet pawls pivotally carried by said first lever means intermediate the ends of the latter and respectively engaging with ends thereof the teeth of said two ratchet wheels for turning the same and said shaft means connected thereto, said cylinder-and-piston means having a stroke to move the teeth engaging ends of the ratchet wheels through a distance slightly greater than half of the circumferential pitch; exchangeable socket means mounted at one end of said shaft means for engaging a polygonal head of a threaded connector for turning the latter, whereby during such turning of the threaded connector in one direction a force is created tending to turn said frame means about the axis of said shaft means in the opposite direction; and means operatively connected to said frame means for counteracting said force.

13. A hydraulic wrench comprising shaft means having an axis; a central ratchet wheel and two additional ratchet wheels to opposite sides of said central ratchet wheel coaxially mounted on said shaft means for rotation therewith about said axis, each of said ratchet wheels having the same number of teeth and the teeth of all ratchet wheels having the same circumferential pitch, the teeth of said two additional ratchet wheels being transversely aligned with each other and the teeth of said central ratchet wheels being circumferentially offset with respect to the teeth of said two additional ratchet wheels through half a pitch; frame means located substantially in a plane normal to the axis of said shaft means and comprising first lever means pivotally connected at one end to said shaft means, second lever means pivotally connected at one end to said shaft means and including an angle with said first lever means, and fluid operated cylinder-and-piston means pivotally connected at opposite ends to the other ends of said first and second lever means, respectively; three ratchet pawls pivotally carried by said first lever means intermediate the ends of the latter and respectively engaging with the ends thereof the three ratchet wheels for turning the same and the shaft means connected thereto, said cylinder-and-piston means having a stroke to move the teeth engaging ends of the ratchet pawls through a distance slightly greater than half of said circumferential pitch; exchangeable socket means mounted at one end of said shaft means for engaging a polygonal head of a threaded connector for turning the latter, whereby during such turning of the threaded connector in one direction a force is created tending to turn said frame means about the axis of said shaft means in the opposite direction; and means operatively connected to said frame means for counteracting said force.

* * * * *